US010539400B1

(12) United States Patent
Nibert et al.

(10) Patent No.: US 10,539,400 B1
(45) Date of Patent: Jan. 21, 2020

(54) MOBILE BALLISTIC SHIELD AND FIRING PLATFORM

(71) Applicant: Shirley Dene Nibert, Gallipolis Ferry, WV (US)

(72) Inventors: Shirley Dene Nibert, Gallipolis Ferry, WV (US); Nathanial C Rimmey, Point Pleasant, WV (US)

(73) Assignee: Shirley Dene Nibert, Gallipolis Ferry, WV (US)

( * ) Notice: Subject to any disclaimer, the term of this patent is extended or adjusted under 35 U.S.C. 154(b) by 0 days.

(21) Appl. No.: 16/513,179

(22) Filed: Jul. 16, 2019

Related U.S. Application Data

(60) Provisional application No. 62/698,656, filed on Jul. 16, 2018.

(51) Int. Cl.
*F41H 5/14* (2006.01)
*F41H 5/18* (2006.01)
*F42B 39/26* (2006.01)

(52) U.S. Cl.
CPC ..... *F41H 5/18* (2013.01); *F42B 39/26* (2013.01)

(58) Field of Classification Search
CPC ..... F41H 5/14; F41H 5/08; F41H 7/00
See application file for complete search history.

(56) References Cited

U.S. PATENT DOCUMENTS

| | | | | |
|---|---|---|---|---|
| 4,245,546 | A | 1/1981 | Chaires | |
| 4,781,101 | A | 11/1988 | Zevuluni | |
| 6,845,701 | B2 | 1/2005 | Drackett | |
| 7,302,880 | B1 | 12/2007 | Elasic | |
| 9,347,748 | B1 * | 5/2016 | Crisp | F41H 5/08 |
| 10,267,601 | B1 * | 4/2019 | Beck | F41H 5/14 |
| 2011/0011255 | A1 * | 1/2011 | Kleniatis | F41H 5/08 89/36.09 |
| 2012/0174768 | A1 * | 7/2012 | Spransy | F41H 5/013 89/36.09 |

FOREIGN PATENT DOCUMENTS

WO WO2015079369 A1 11/2014

* cited by examiner

*Primary Examiner* — J. Woodrow Eldred

(57) ABSTRACT

A hand-maneuverable ballistic shield and firing apparatus provides a means for defending a user from ballistic threats while simultaneously providing a mobile platform from which to return fire. Additionally, the apparatus offers a means of ammunitions storage allowing the user to easily reload and resupply during long engagements. The apparatus may be converted to be used in conjunction with any weapon system for any purpose, including riot control, home defense, hostage rescue, internal security, and direct action. Further, the apparatus features a means of observing the environment through the protective portion of the shield platform. The shield platform offers adjustable portions of the user-facing components to allow for operation by both left-handed and right-handed individuals to facilitate operation by the user.

20 Claims, 9 Drawing Sheets

MOBILE BALLISTIC SHIELD AND FIRING PLATFORM

The current application claims a priority to the U.S. Provisional Patent application Ser. No. 62/698,656 filed on Jul. 16, 2018.

FIELD OF THE INVENTION

The present invention relates generally to ballistic shields. More specifically, the present invention relates to a mobile ballistic obstacle and firing platform intended to be used in conjunction with a projectile weapon such as a paintball marker.

BACKGROUND OF THE INVENTION

In present times, individuals are known to encounter threats from individuals armed with a variety of types and calibers of ballistic weapons. These threats are most hazardous when encountered inside an interior, close-quarters environment wherein an individual may be forced to traverse narrow corridors and passages in full view of an armed individual. This scenario will often result in the injury or death of an individual without the benefit of either overwhelming firepower, numerical superiority, or specialized urban warfare training. In place of these factors, individuals are known to use cover to break line-of-sight from an armed individual. These covers are known to take the form of walls, doors, low-barriers, and improvised structures like barricades, debris piles, and vehicles. In some cases, individuals may be equipped with portable tactical shields with which they may maneuver under fire with increased odds of survival. However, these improvised and carriable means of defense do not necessarily allow a user to respond to a threat, only to defend and evade. Additionally, the means described above offer either incomplete or immobile cover to a user, even when employed by an individual with specific training regarding effective counters to threats in a specific scenario.

The present invention aims to offer a means of mobile, maneuverable cover with integrated support for a weapons platform with which a user may accurately respond to armed threats with minimal risk of injury. The present invention additionally offers a means of munitions storage integrated to the protected portion of the apparatus, allowing a user to easily reload and resupply during long engagements. Various implementations of the present invention may incorporate less-than-lethal munitions, such as paintballs, rubber bullets, and pepper spray projectiles (including specially filled paintballs). The present invention may be converted to be used in conjunction with any weapon system for any purpose, including riot control, home defense, hostage rescue, internal security, and direct action.

SUMMARY OF THE INVENTION

The present invention aims to offer an apparatus of a mobile, maneuverable shield with integrated support for a weapons platform with which a user may accurately respond to armed threats with minimal risk of injury. Additionally, the shield platform apparatus offers a means of ammunition storage integrated to the protected portion of the apparatus, allowing the user to easily reload and resupply during long engagements. Various implementations of the present invention may incorporate less-than-lethal munitions, such as paintballs including specially filled paintballs, rubber bullets, and pepper spray projectiles. The present invention may be converted to be used in conjunction with any weapon system for any purpose, including riot control, home defense, hostage rescue, internal security, and direct action. Further, to facilitate operation by the user, the shield platform features a means of observing the environment through the protective portion of the shield platform. The shield platform offers adjustable portions of the user-facing components to allow for operation by both left-handed and right-handed individuals.

DETAIL DESCRIPTIONS OF THE INVENTION

Figure 1:
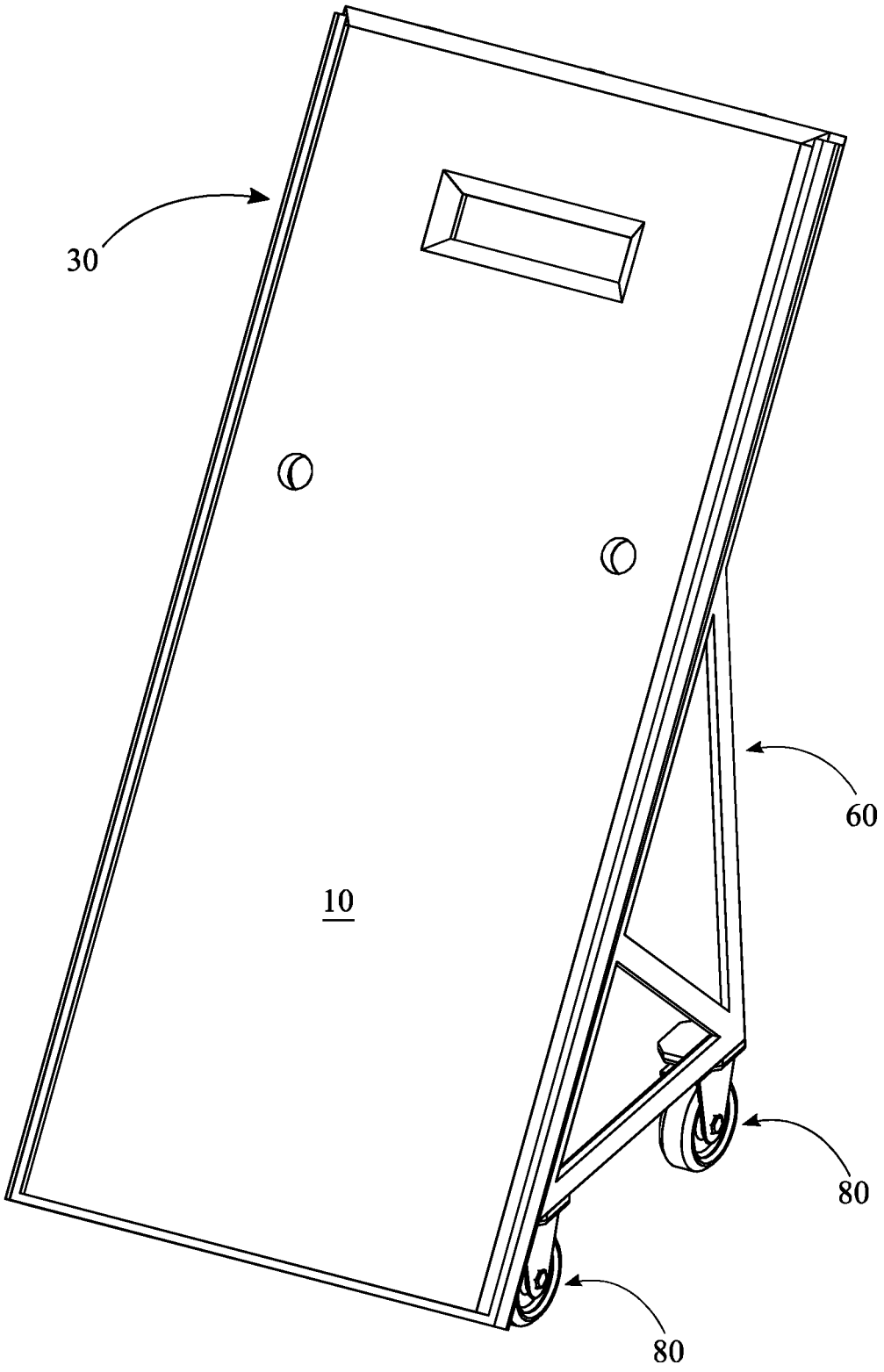
FIG. 1 is a frontal perspective view of the present invention.

All illustrations of the drawings are for the purpose of describing selected versions of the present invention and are not intended to limit the scope of the present invention.

The present invention comprises a mobile hand-maneuverable ballistic shield and firing platform, called shield platform. The shield platform of the present invention aims to offer an apparatus of mobile, maneuverable guard with integrated support for a weapons' platform with which a user may accurately respond to armed threats with minimal risk of injury. Additionally, the present invention offers a means of ammunitions storage integrated to the protected portion of the shield platform, allowing the user to easily reload and resupply during long engagements. Various embodiments of the shield platform of the present invention may include, but are not limited to, less-than-lethal ammunitions, such as paintballs, paintballs filled with mace and/or other gases, rubber bullets, and pepper spray projectiles, or any other ammunitions. The shield platform may be converted to be used in conjunction with any weapon system for any purpose, including, but not limited to, riot control, home defense, hostage rescue, internal security, and direct action.

The shield platform of the present invention aims to provide a means of defending the user from ballistic threats while simultaneously providing a mobile platform from which the user can return fire. Additionally, the shield platform includes a means of storing additional ammunitions within or attached to the apparatus. Further, to facilitate operation by the user, the shield platform features a means of observing the environment through the protective portion of the shield platform. The shield platform offers adjustable portions of the user-facing components to allow for operation by both left-handed and right-handed individuals.

As can be seen in FIG. 1 to FIG. 9, the shield platform of the present invention comprises a guard 10, a magazine 20, a frame 30, a brace 60, and a plurality of casters 80. More specifically, the guard 10 constitutes the ballistic resistive component of the shield platform, angled towards any incoming threats and providing defensive measures to the user. Additionally, the guard 10 is ideally a removeable component, either for repair, maintenance, or replacement, detachably attached to the front of the frame 30. The frame 30 constitutes the primary structural component of the shield platform apparatus, supporting the guard 10 to the front, the plurality of casters 80 below, and the brace 60 to the rear. The frame 30 is ideally a permanent component of the shield platform apparatus, comprising all means and positions of attachment for all other components. The magazine 20 is detachably mounted to the second girder 62 of the brace 60, opposite the guard 10, and is primarily used to provide storage for ammunitions. Additionally, the magazine 20 may be positioned anywhere to the rear of the guard 10, mounted to the frame 30, brace 60, or directly to the user-facing portion of the guard 10. This magazine 20 may be modified, resupplied, or adjusted to suite a variety of use-cases. The guard 10 may be made of a bullet-proof and/or a transparent material.

Figure 2:
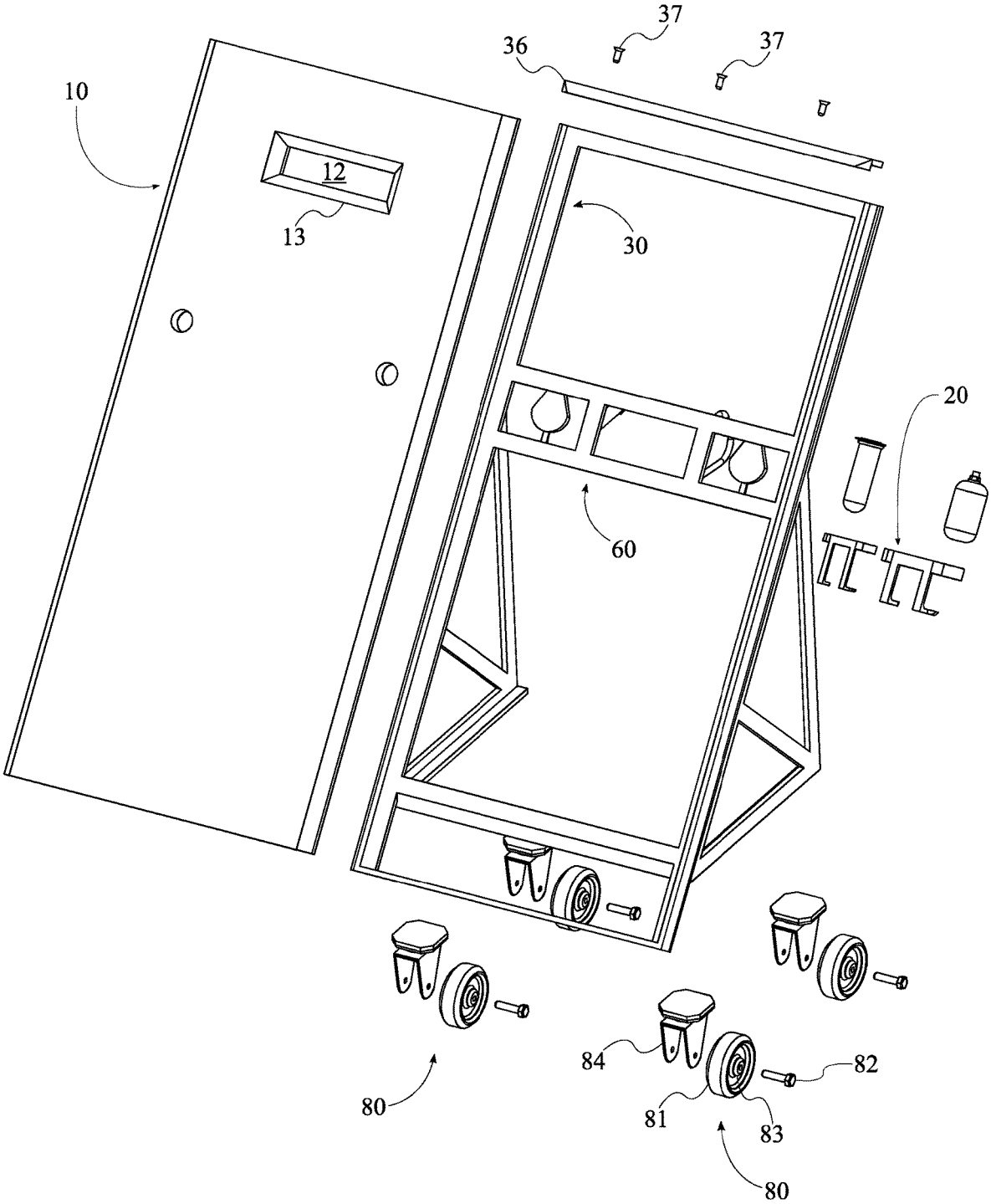
FIG. 2 is an exploded view of the present invention.
Figure 3:
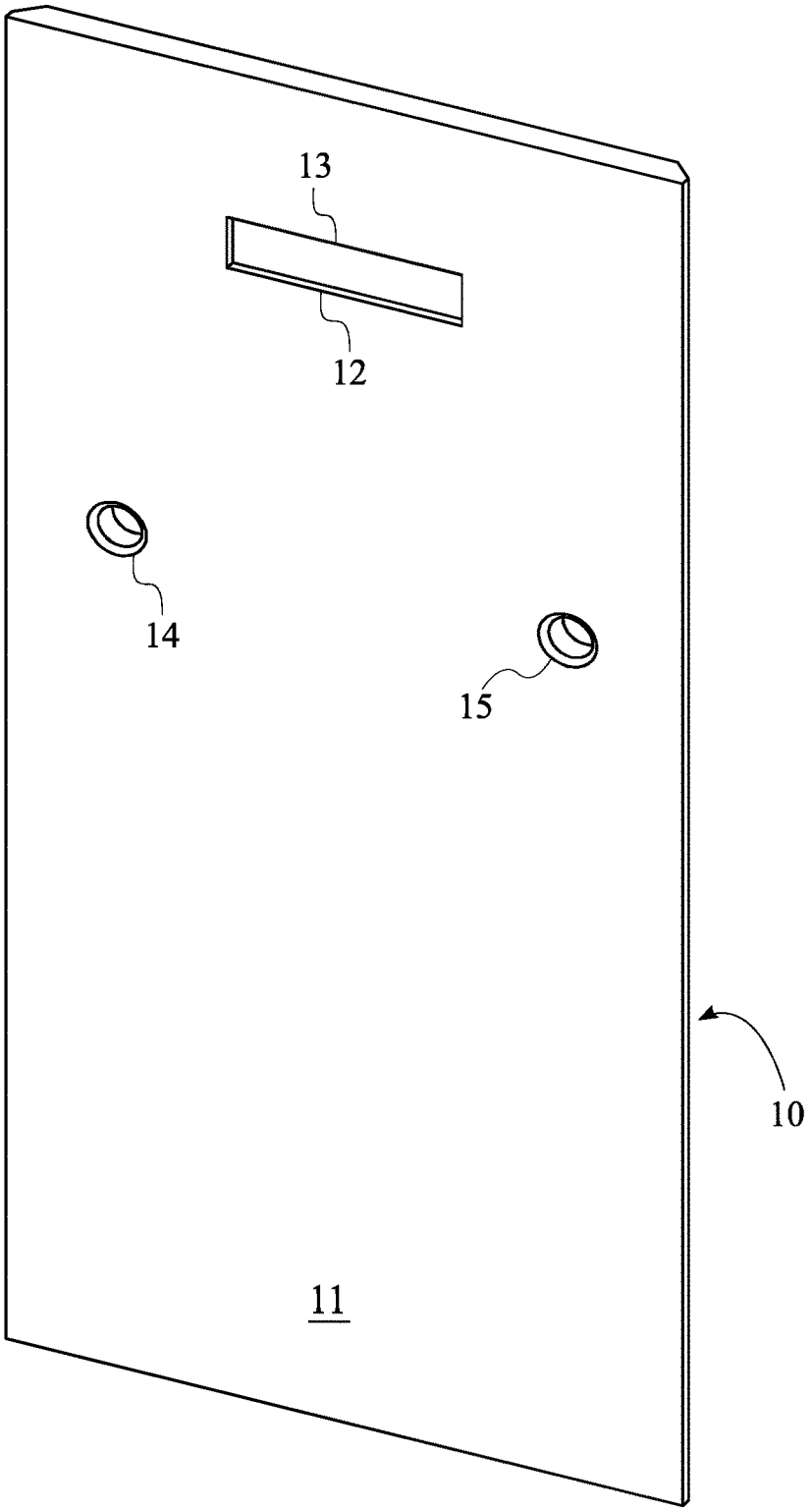
FIG. 3 is a rear perspective view of the guard.

As can be seen in FIG. 2 and FIG. 3, the guard 10 comprises a panel 11, a port 12, a screen 13, a first aperture 14 and a second aperture 15. More specifically, the panel 11 may comprise, but is not limited to, a ballistic material that may be of any shape, composition, or arrangement. In the preferred embodiment of the present invention, the panel 11 comprises a bulletproof steel plate three feet wide, six feet tall. In alternate embodiments, the panel 11 may include, but is not limited to, an optically clear material, bonded layers of metallic and composite materials, interwoven or overlapped sections of similar compositions, and directly abutted segments of variable or similar composition. The port 12 defines a perforation traversing the width of the panel 11 at the approximate eye-level of the user. This port 12 is positioned on the panel 11 adjacent the first truss 33 of the frame 30. Additionally, the port 12 is ideally structured to allow the user to view the environment to the front of the shield platform without exposing themselves to harm. In alternate embodiments of the present invention, the port 12 may be sealable or otherwise obstructed by the user. In other embodiments, the port 12 may be unnecessary due to the optically clear nature of the panel 11. The screen 13 is attached to the port 12 to fully cover the port 12 and positioned opposite the first leg 38 and the second leg 39 of the frame 30. Additionally, the screen 13 may include, but is not limited to, an optically clear ballistic-resistant material affixed on the exterior of, or within the port 12. This screen 13 may be described as metallic or composite, of any material or composition provided that the screen 13 enables the user to observe the environment to the front of the shield platform. Further, the screen 13 may provide this function by a periscopic assembly, a camera system, or any other means of remote viewing without departing from the original scope of the invention. As can be seen in FIG. 3, the first aperture 14 and the second aperture 15 are distally and laterally positioned across the panel 11. More specifically guard the first aperture 14 defines a perforation approximately waist-level to the user, offset to a lateral side of the panel 11. This first aperture 14 allows the user to fire a weapon from behind the panel 11 without exposing themselves to any threats that may be present to the front of the shield platform apparatus. The first aperture 14 may include, but is not limited to a captive ball, barrel lock, or other means of securing the forward portion of a projectile weapon in alternative embodiments. The second aperture 15 defines a similar perforation to the first aperture 14, positioned to the lateral side of the panel 11, opposite the aperture 14. The second aperture 15 features all the same possible embodiments as the first aperture 14.

Figure 4:
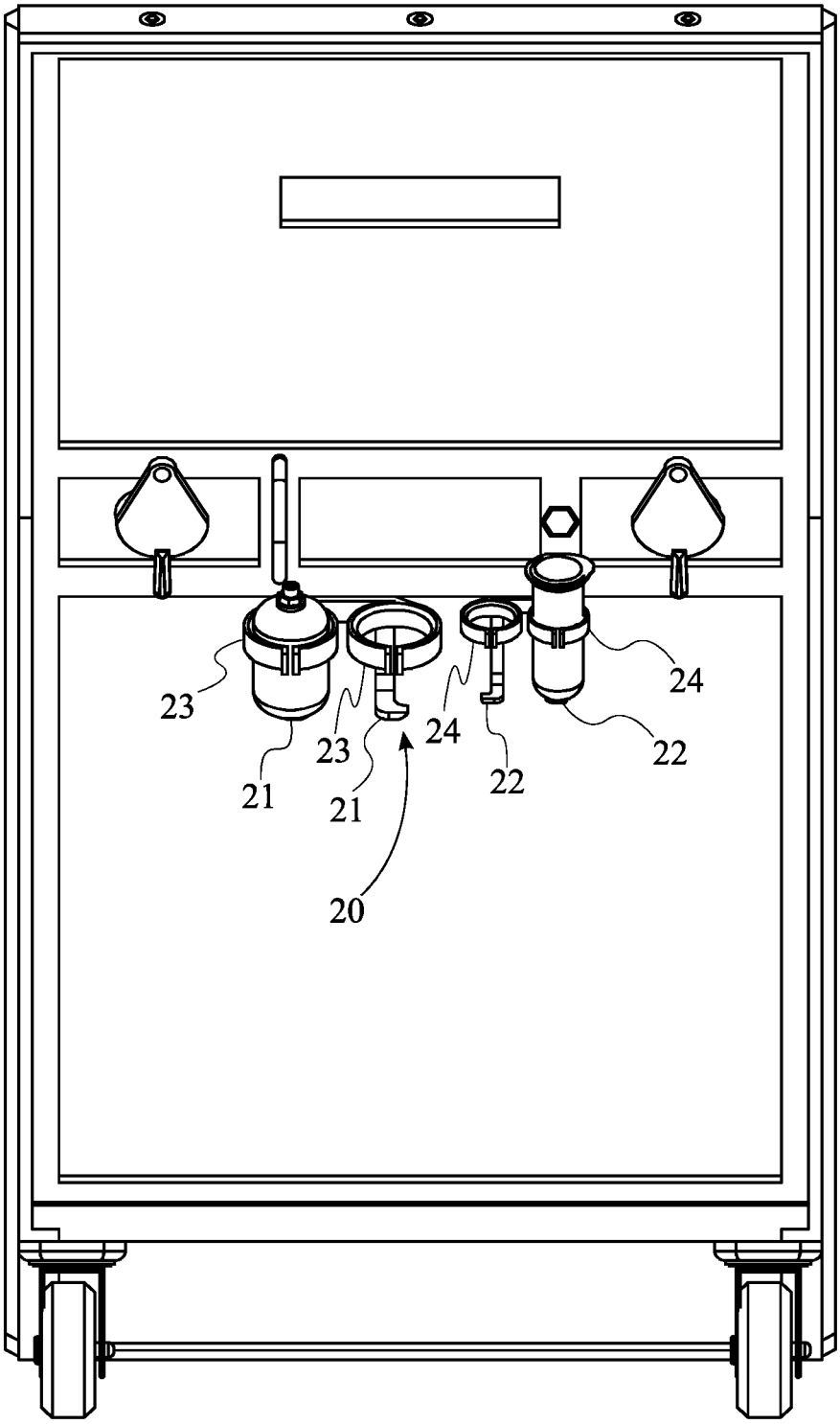
FIG. 4 is a rear perspective view of the present invention, wherein a tank and a pod have been mounted for reference.
Figure 5:
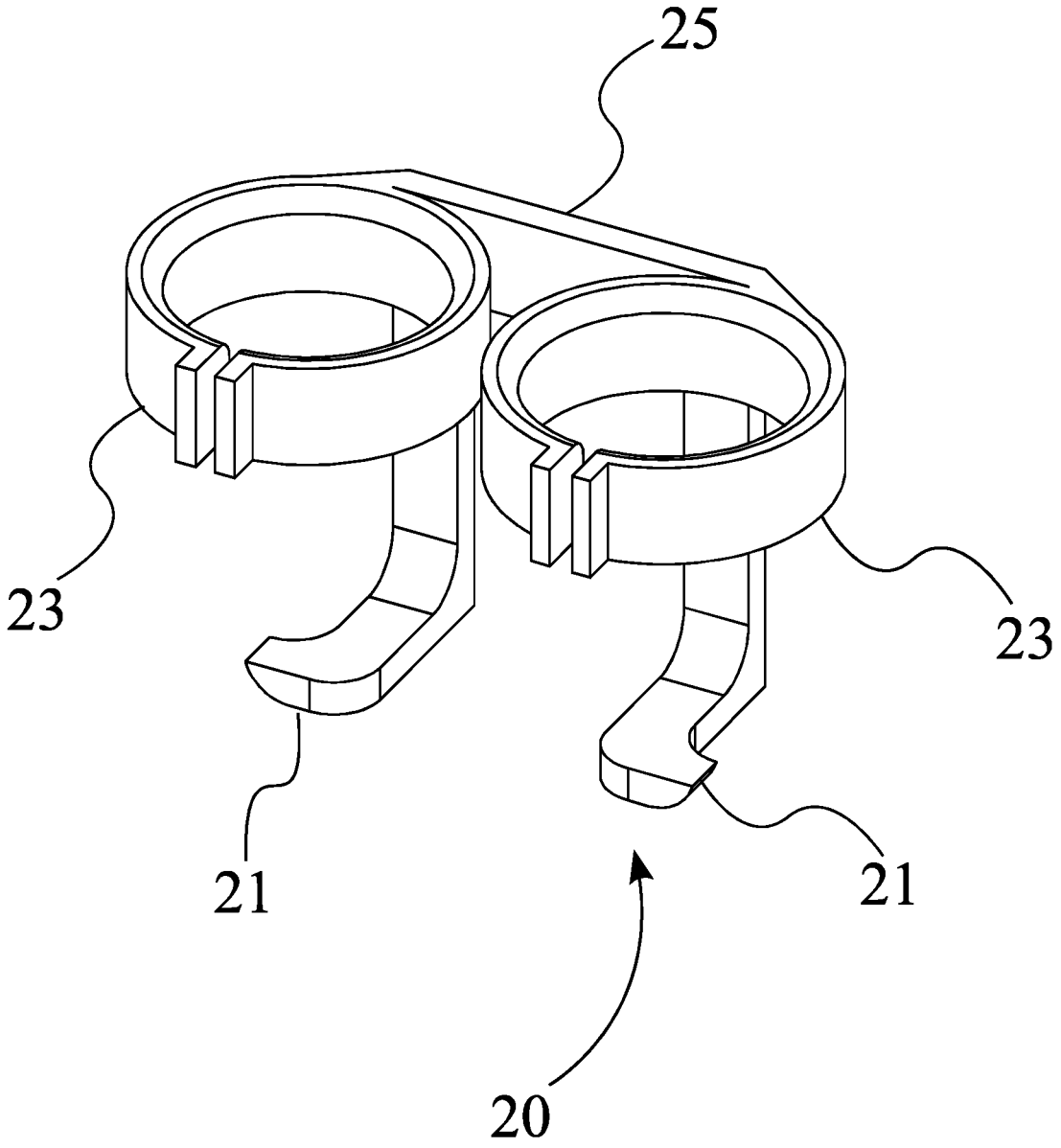
FIG. 5 is a magnified perspective view of a receptacle and a clamp of the magazine of the present invention.
Figure 6:
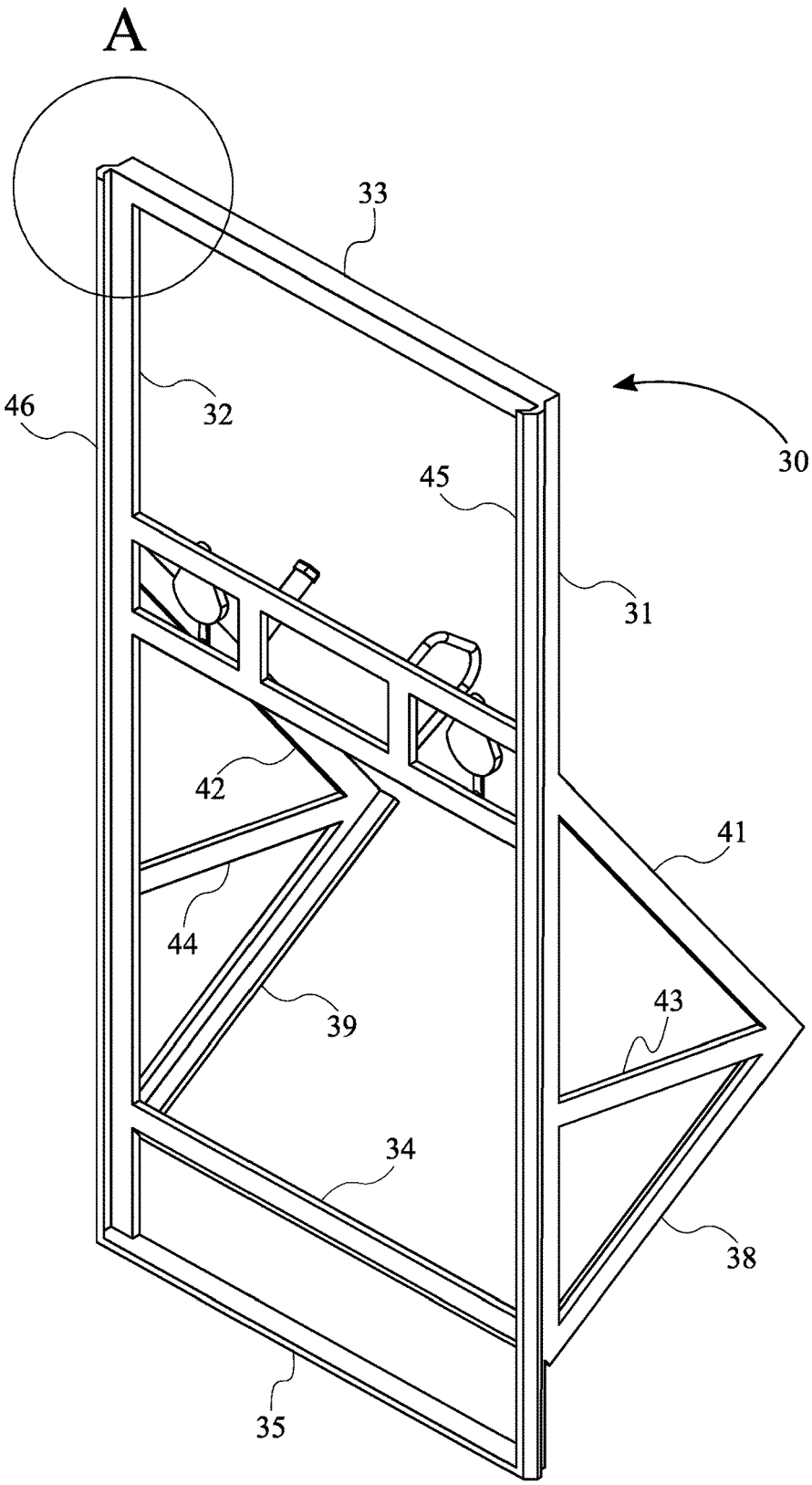
FIG. 6 is a side perspective view of the present invention illustrating a sectional view A.

The magazine 20, used hereafter to refer to a general storage area for ammunitions, comprises a plurality of first receptacles 21, a plurality of second receptacles 22, a plurality of first clamps 23, a plurality of second clamps 24, and a holding bracket 25. As can be seen in FIG. 4 and FIG. 5, each of the plurality of first receptacles 21 is connected to each of the plurality of first clamps 23, and together, the plurality of first receptacles 21 and the plurality of first clamps 23 are attached to the holding bracket 25. Additionally, each of the plurality of second receptacles 22 is connected to each of the plurality of second clamps 23, and together, the plurality of second receptacles 21 and the plurality of second clamps 23 are attached to the holding bracket 25. Further, the holding bracket 25 is mounted to the second girder 62 of the brace 60. More specifically, the plurality of first receptacles 21 is ideally suited to support variously sized "pods" of ammunitions including, but not limited to paintball. The plurality of first clamps 23 secures these "pods" into position within the plurality of first receptacles 21 until detached by the user. The plurality of second receptacles 22 is ideally suited to support variously sized pressurized gas tanks intended to power weapons including, but not limited to, paintball markers. As can be seen in FIG. 5, the plurality of second clamps 24 secures these tanks into position until removed by the user. The pods and tanks referenced above may be substituted for any form or combination of ammunition, weaponry, medical supplies, communications equipment, auxiliary protective equipment, or any other suitable materiel in alternative embodiments and applications of the present invention. Each of the plurality of first receptacles 21 is attached to each of the plurality of first clamps 23, and together, the plurality of first receptacles 21 and the plurality of first clamps 23 are attached to the holding bracket 25. Additionally, each of the plurality of second receptacles 22 is attached to each of the plurality of second clamps 24, and together, the plurality of second receptacles 22 and the plurality of second clamps 24 are attached to the holding bracket 25. Further, the magazine 20 may be moveably mounted to the second girder 62 of the brace 20 opposite the guard 10, or any component of the shield platform, through the holding bracket 25 and using common suitable fasteners including, but not limited to, screws, bolts and nuts, adhesive, magnetic coupler, or any other suitable means of attachment without departing from the scope of the present invention.

Figure 7:
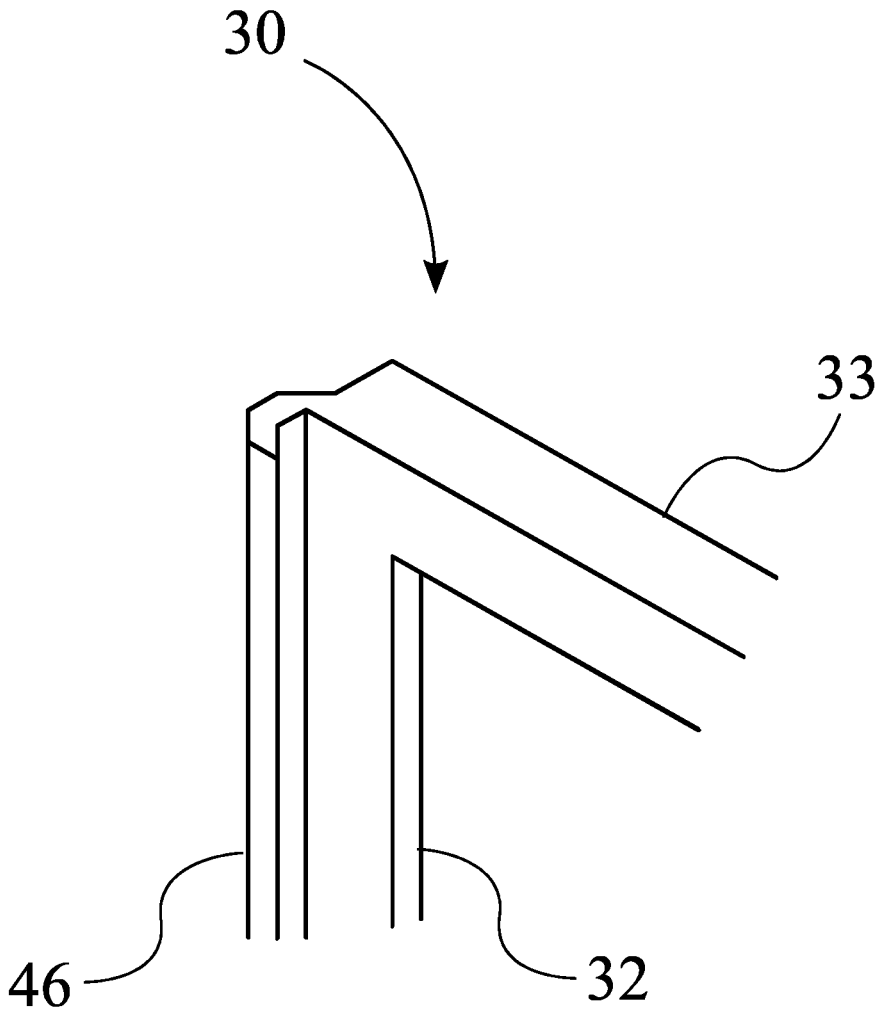
FIG. 7 is a magnified sectional perspective view A of the frame of the present invention.

As can be seen in FIG. 1 to FIG. 2 and FIG. 6 to FIG. 7, the frame 30 comprises a first stanchion 31, a second stanchion 32, a first truss 33, a second truss 34, a tray 35, a block 36, a plurality of second fasteners 37, a first leg 38, a second leg 39, a first strut 41, a second strut 42, a third strut 43, a fourth strut 44, a first guide 45, and a second guide 46. More specifically, the first stanchion 31 and the second stanchion 32 are laterally positioned across the frame 30 opposite each other. Additionally, the first stanchion 31 and the second stanchion 32 constitute long, parallel upright segments linked together by the first truss 33 at the top, and the second truss 34 at the bottom to form a rectangle. Further, the first stanchion 31 and the second stanchion 32 are equipped with the first guide 45 and the second guide 46, respectively. As can be seen in FIG. 7, the first guide 45 and second guide 46 are colinearly and terminally attached to the front of the first stanchion 31 and the second stanchion 32, respectively. The tray 35 is terminally attached to the first stanchion 31 and the second stanchion 32, adjacent to the second truss 34. The block is colinearly inserted to the first truss 33 and is mounted to the first truss 33 using the plurality of second fasteners 37. More specifically, the first guide 45 and the second guide 46 are ideally positioned to support and capture the edges of the guard 10, indexing it into a colinear alignment with the first guide 45, second guide 46, first stanchion 31, and second stanchion 32. The first truss 33 is terminally positioned on both the first stanchion 31 and the second stanchion 32, while the second truss 34 is positioned between the first stanchion 31 and the second stanchion 32 opposite the first truss 33. As can be seen in FIG. 2, the guard 10 may slide freely within the first guide 45 and the second guide 46 until reaching the tray 35, positioned below and beyond the second truss 34. Additionally, the tray 35 defines the terminal points of the first guide 45 and the second guide 46. As can be seen in FIG. 1 and FIG. 2, the block 36 may be colinearly inserted and fixed adjacent and parallel to the first truss 33 in order to lock the guard 10 into position within the frame 30. The block 36 is further mounted into position by the plurality of second fasteners 37, preferably a series of bolts traversing the block 26 and threading into the first truss 33. The plurality of second fasteners 37 and the block 36 may be removed to allow the guard 10 to slide free of the frame 30. The first leg 38 is attached to the first stanchion 31 opposite the guard 10 and adjacent the second truss 34. Specifically, the proximal end of the first leg 38 is linked to the lower end of the first stanchion 31 in such a way as to support the first stanchion 31 at an acute angle when the first leg 31 is laid flat to the ground. The distal end of the first leg 31 is linked to the distal end of the first strut 41. The first strut 41 and the second strut 42 are terminally attached to the first leg 38 and the second leg 39, respectively. Additionally, the first strut 41 and the second strut 42 being terminally attached to the first stanchion 31 and the second stanchion 32, respectively, and adjacent the brace 60. The third strut 43 is terminally connected to the first stanchion 31 and the joint between the first leg 38 and the first strut 41, while the fourth strut 44 is terminally connected to the second stanchion 32 and the joint between the second leg 39 and the second strut 42. Additionally, the third strut 43 and fourth strut 44 are positioned perpendicularly to the first stanchion 31 and the second stanchion 32, respectively. The proximal end of the first strut 41 is positioned roughly upright, with the proximal end linked to roughly the middle portion of the first stanchion 31. The second leg 39 is attached to the second stanchion 32 opposite the first leg 33 along the second truss 34. More specifically, the second leg 39 is linked to the second stanchion 32 in a similar, opposite fashion to the first leg 31. The second strut 42 is linked to the second leg 39 in a similar, opposite fashion to the first strut 41. The second strut 42 is linked to the second stanchion 32 in a similar, opposite fashion to the first strut 41. The third struct 43 projects from the joint between the first leg 38 and the first strut 41 to conjoin with the first stanchion 31 in a roughly perpendicular arrangement. The fourth strut 44 projects from the joint of the second leg 39 and the second strut 42 to conjoin with the second stanchion 32 in a similar, opposite manner to the third strut 43.

Figure 8:
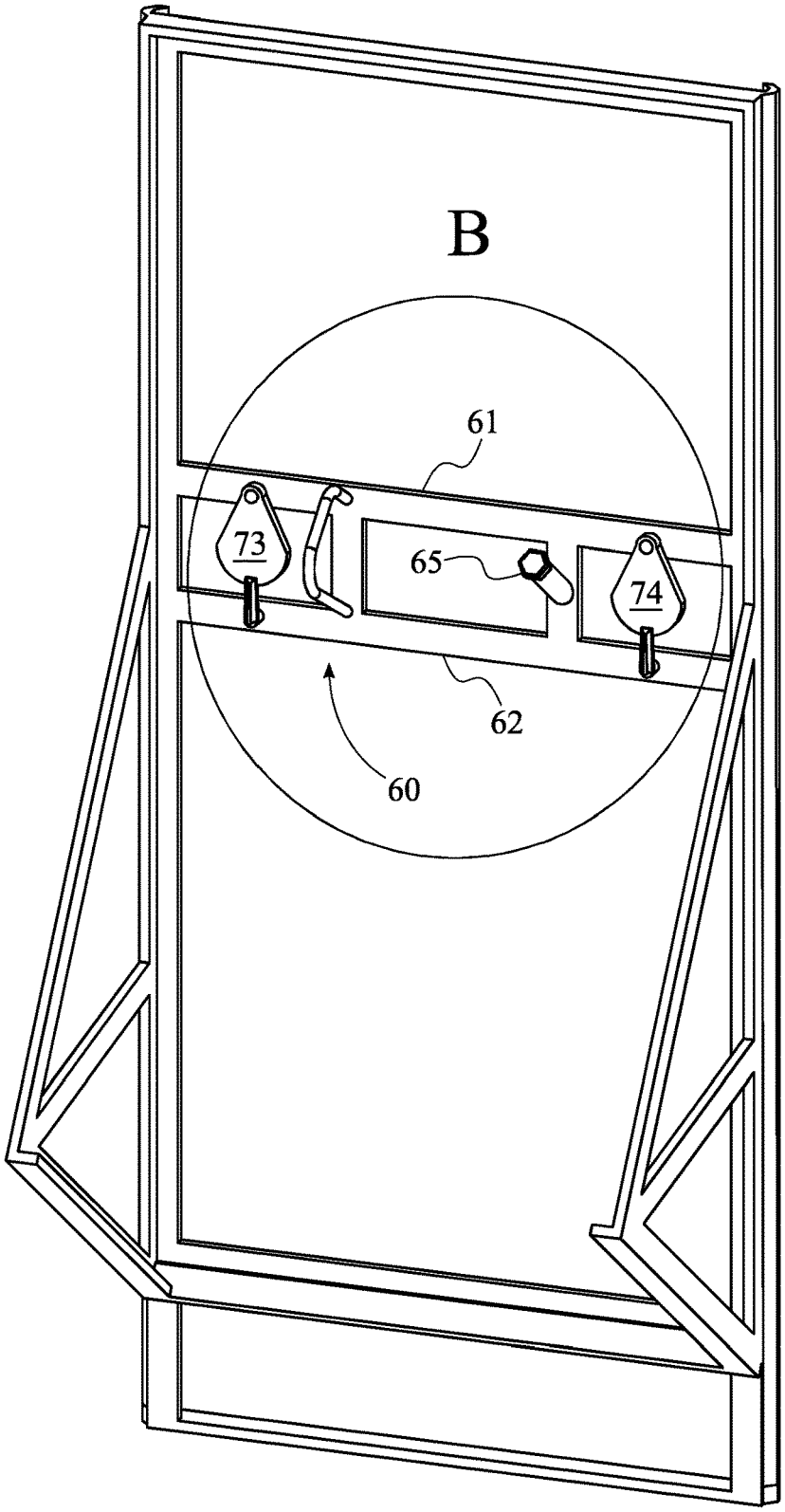
FIG. 8 is a rear perspective view of the present invention illustrating a sectional view B.
Figure 9:
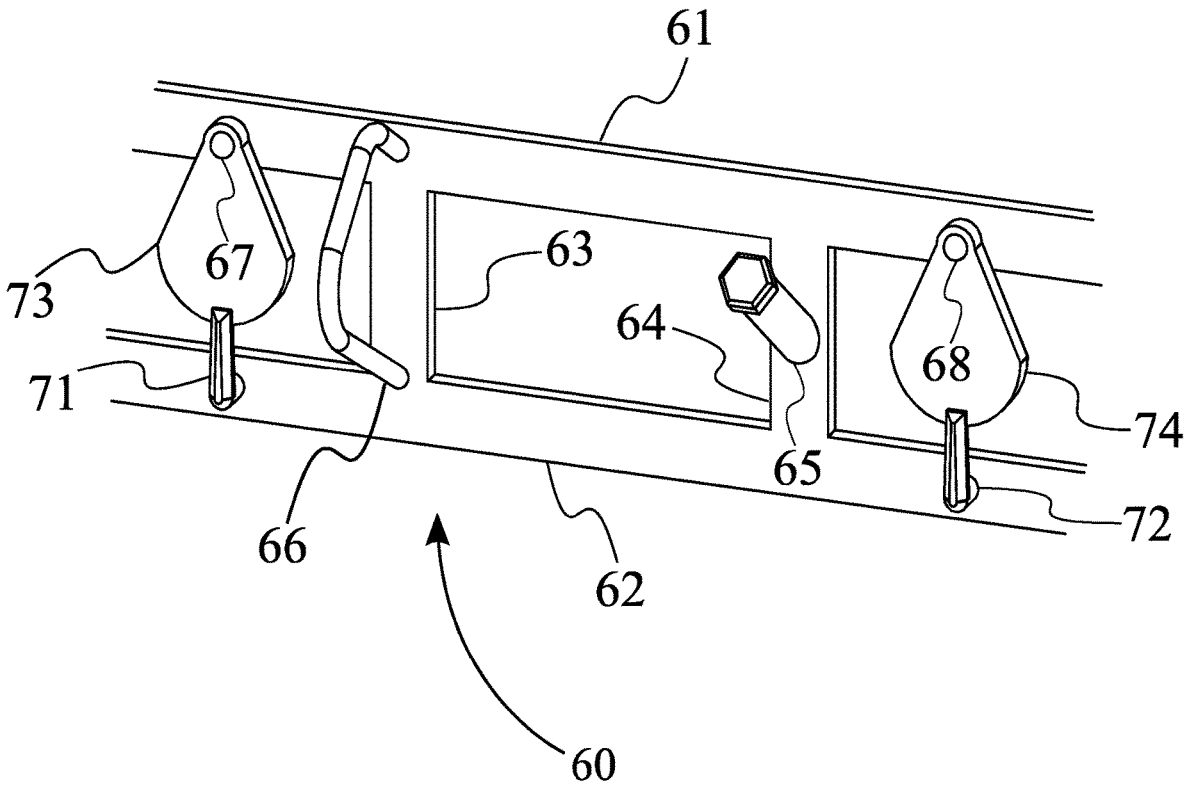
FIG. 9 is a magnified sectional perspective view B of the brace of the present invention.

As can be seen in FIG. 8 and FIG. 9, the brace 60 comprises a first girder 61, a second girder 62, a first tie 63, a second tie 64, a haft 65, a loop 66, a first pivot 67, a second pivot 68, a first latch 71, a second latch 72, a first stopple 73, and a second stopple 74. The first girder 61 and the second girder 62 are attached to between the first stanchion 31 and the second stanchion 32 of the frame 30, adjacent the longitudinal midpoint. The first girder 61 is positioned on the frame 30 adjacent the first truss 33 and opposite the second girder 62. More specifically, the first girder 61 and the second girder 62 are arranged horizontally, parallel to each other. The first girder 61 is linked to the second girder 62 by the first tie 63 and the second tie 64, positioned vertically and parallel to each other. The first girder 63 and second girder 64 are terminally attached to the first girder 61 and the second girder 62, and are fixed to the midpoint of the first stanchion 31 and second stanchion 32 of the frame 30, respectively, such that the first girder 61 is parallel to the first truss 33 of the frame 30. The first tie 63 is positioned adjacent stanchion 31 of the frame 30, opposite the second tie 64 along the first girder 61. As can be seen in FIG. 9, the loop 66 is attached to the first girder 61 and the second girder 62 opposite the guard 10, while the haft 65 is attached to the second tie 64 opposite the guard 10. More specifically, the haft 65 and loop 66 are positioned interchangeable atop the first tie 63 and the second tie 64. A left-handed user may insert their right hand through the loop 66 positioned on the second tie 64 and grasp the haft 65 positioned on the first tie 63. A right-handed user may insert their left hand through the loop 66 positioned on the first tie 63 and grasp the haft 65 positioned on the second tie 64. This arrangement will leave the user's dominant hand free to operate a weapon system while their offhand maintains control of the shield platform. The first pivot 67 and the second pivot 68 are mounted to the first girder 61 and positioned adjacent the first stanchion 31 and the second stanchion 32 of the frame 30, respectively, and opposite the guard 10. The first stopple 73 and the second stopple 74 are concentrically and rotatably attached to the first pivot 67 and the second pivot 68, respectively. The first latch 71 and the second latch 72 are mounted to the second girder 62 and positioned adjacent the first stopple 73 and the second stopple 74, respectively. Additionally, the first stopple 73 and the second stopple 74 are latched by the first latch 67 and the second latch 68, respectively, when not in use; and the first stopple 73 and the second stopple 78 are positioned opposite the first aperture 14 and the second aperture 15 of the guard 10, respectively, when latched. Further, the first stopple 73 is mounted on the brace 60 via the first pivot 67, ideally allowing the first stopple 73 to hang concentrically with the associated first aperture 14 of the guard 10 component. This first stopple 73 may by maneuvered aside to allow the user to fire through the shield platform from behind the protection of the guard 10. The first stopple 73 may be allowed to swing back into position when not in use, covering and sealing the path that may otherwise expose a user. The first latch 71 may be used to secure the first stopple 73 in the "closed" position when not in use to prevent exposing the user through the first aperture 14. The second pivot 68 and second stopple 74 are arranged similarly and opposite to the first pivot 67 and first stopple 73. The second stopple 74 ideally hangs concentrically with the second aperture 15 of the associated guard 10. The second latch 72 secures the second stopple 74 in the "closed" position when not in use to prevent exposing the user through the second aperture 15.

As can be seen in FIG. 2, the plurality of casters 80 comprises a wheel 81, an axle 82, a bearing 83, and a bracket 84. The bearing 83 is permanently fixed to the bracket 84, allowing the bracket 84 to rotate independently from the bearing 83 along an axis defined concentric to the bearing 83. The axle 82 will traverse the width of the bearing 83, allowing the wheel 81 to ride on the axle 82. The wheel 81 revolves freely on the axle 82, while simultaneously rotating with the bracket 84 about the axis defined by the bearing 83. This shield platform apparatus allows the plurality of casters 80 to support rapid, multiple axial direction shifts to meet the needs of the user maneuvering the shield platform apparatus through tight confines, including, but not limited to, buildings or hallways. As can be seen in FIG. 2, the plurality of casters 80 is fixed to the frame 30 in ideally four locations. These locations are defined by the intersection of the first leg 38 and the second truss 34, the intersection of the second leg 39 and the second truss 34, the intersection of the first leg 38 and the first strut 41, and the intersection of the second leg 39 and the second strut 42. The plurality of casters 80 is aligned downwards from a common plane defined by the first leg 38, second leg 39, and second truss 34.

Although the invention has been explained in relation to its preferred embodiment, it is to be understood that many other possible modifications and variations can be made without departing from the spirit and scope of the invention as hereinafter claimed.

What is claimed is:

1. A mobile hand-maneuverable ballistic shield and firing platform comprising:

a guard;

a frame;

a brace;

a plurality of casters;

the guard comprising a panel, a first aperture, and a second aperture;

the first aperture and the second aperture being distally and laterally positioned across the panel;

the guard being detachably attached to the front of the frame;

the frame comprising a first stanchion, a second stanchion, a first truss, a second truss, a first leg, and a second leg;

the first stanchion and the second stanchion being laterally positioned across the frame opposite each other;

the first truss being terminally positioned on both the first stanchion and the second stanchion;

the second truss being positioned between the first stanchion and the second stanchion opposite the first truss;

the first leg being attached to the first stanchion opposite the guard and adjacent the second truss;

the second leg being attached to the second stanchion opposite the first leg along the second truss;

the brace comprising a first girder, a second girder, a first tie, a second tie, a haft, and a loop;

the first girder and the second girder being attached to between the first stanchion and the second stanchion of the frame, adjacent the longitudinal midpoint;

the first girder being positioned on the frame adjacent the first truss and opposite the second girder;

the first tie and the second tie being terminally attached to the first girder and the second girder;

the first tie being positioned adjacent first stanchion of the frame, opposite the second tie along the first girder;

the loop being attached to the first girder and the second girder opposite the guard;

the haft being attached to the second tie opposite the guard; and the plurality of casters being terminally mounted to the first leg and the second leg of the frame.

2. The mobile hand-maneuverable ballistic shield and firing platform as claimed in claim 1, wherein the panel of the guard is bullet-proof.

3. The mobile hand-maneuverable ballistic shield and firing platform as claimed in claim 1 comprising:

the guard comprising a port and a screen;

the port being positioned on the panel adjacent the first truss;

the screen being attached to the port to fully cover the port; and the screen being positioned opposite the first leg and the second leg of the frame.

4. The mobile hand-maneuverable ballistic shield and firing platform as claimed in claim 1, wherein the panel of the guard is transparent.

5. The mobile hand-maneuverable ballistic shield and firing platform as claimed in claim 1 comprising:

the frame comprising a first guide, a second guide, a tray, a block, and a plurality of fasteners;

the first guide and second guide being colinearly and terminally attached to the front of the first stanchion and the second stanchion, respectively;

the tray being terminally attached to the first stanchion and the second stanchion, adjacent to the second truss;

the block being colinearly inserted to the first truss; and the block being mounted to the first truss using the plurality of second fasteners.

6. The mobile hand-maneuverable ballistic shield and firing platform as claimed in claim 1 comprising:

the frame comprising a first strut, a second strut, a third strut, and a fourth strut;

the first strut and the second strut being terminally attached to the first leg and the second leg, respectively;

the first strut and the second strut being terminally attached to the first stanchion and the second stanchion, respectively, and adjacent the brace;

the third strut being terminally connected to the first stanchion and the joint between the first leg and the first strut;

the fourth strut being terminally connected to the second stanchion and the joint between the second leg and the second strut; and the third strut and fourth strut being positioned perpendicularly to the first stanchion and the second stanchion, respectively.

7. The mobile hand-maneuverable ballistic shield and firing platform as claimed in claim 1, wherein the guard and the frame are supported at an acute angle with respect to the first leg and the second leg of the frame.

8. The mobile hand-maneuverable ballistic shield and firing platform as claimed in claim 1 comprising:

the brace comprising a first pivot, a second pivot, a first latch, a second latch, a first stopple, and a second stopple;

the first pivot and the second pivot being mounted to the first girder;

the first pivot and the second pivot being positioned adjacent the first stanchion and the second stanchion of the frame, respectively, and opposite the guard;

the first stopple and the second stopple being concentrically and rotatably attached to the first pivot and the second pivot, respectively;

the first latch and the second latch being mounted to the second girder;

the first latch and the second latch being positioned adjacent the first stopple and the second stopple, respectively;

the first stopple and the second stopple being latched by the first latch and the second latch, respectively; and the first stopple and the second stopple being positioned opposite the first aperture and the second aperture of the guard, respectively, when latched.

9. The mobile hand-maneuverable ballistic shield and firing platform as claimed in claim 1 comprising:

each of the plurality of casters comprising a wheel, an axle, a bearing, and a bracket;

the wheel being concentrically and rotatably mounted to the bearing;

the bearing being concentrically and rotatably mounted to the axle;

the axle being mounted to the bracket; and the bracket being terminally mounted to the frame.

10. The mobile hand-maneuverable ballistic shield and firing platform as claimed in claim 1 comprising:

a magazine;

the magazine being detachably mounted to the second girder of the brace, opposite the guard; and wherein the magazine is used to provide storage for ammunitions.

11. The mobile hand-maneuverable ballistic shield and firing platform as claimed in claim 10 comprising:

the magazine comprising a plurality of first receptacles, a plurality of second receptacles, a plurality of first clamps, a plurality of second clamps, and a holding bracket;

each of the plurality of first receptacles being connected to each of the plurality of first clamps;

the plurality of first receptacles and the plurality of first clamps being attached to the holding bracket;

each of the plurality of second receptacles being connected to each of the plurality of second clamps;

the plurality of second receptacles and the plurality of second clamps being attached to the holding bracket; and the holding bracket being mounted to the second girder of the brace.

12. A mobile hand-maneuverable ballistic shield and firing platform comprising:

a guard;

a frame;

a brace;

a plurality of casters;

a magazine;

the guard comprising a panel, a first aperture, and a second aperture;

the first aperture and the second aperture being distally and laterally positioned across the panel;

the guard being detachably attached to the front of the frame;

the frame comprising a first stanchion, a second stanchion, a first truss, a second truss, a first leg, and a second leg;

the first stanchion and the second stanchion being laterally positioned across the frame opposite each other;

the first truss being terminally positioned on both the first stanchion and the second stanchion;

the second truss being positioned between the first stanchion and the second stanchion opposite the first truss;

the first leg being attached to the first stanchion opposite the guard and adjacent the second truss;

the second leg being attached to the second stanchion opposite the first leg along the second truss;

the brace comprising a first girder, a second girder, a first tie, a second tie, a haft, and a loop;

the first girder and the second girder being attached to between the first stanchion and the second stanchion of the frame, adjacent the longitudinal midpoint;

the first girder of the brace being positioned on the frame adjacent the first truss and opposite the second girder;

the first tie and the second tie being terminally attached to the first girder and the second girder;

the first tie being positioned adjacent first stanchion of the frame, opposite the second tie along the first girder;

the loop being attached to the first girder and the second girder opposite the guard;

the haft being attached to the second tie opposite the guard; and the plurality of casters being terminally mounted to the first leg and the second leg of the frame;

the magazine being detachably mounted to the second girder of the brace, opposite the guard; and wherein the magazine is used to provide storage for ammunitions.

13. The mobile hand-maneuverable ballistic shield and firing platform as claimed in claim 12, wherein the panel of the guard is bullet-proof.

14. The mobile hand-maneuverable ballistic shield and firing platform as claimed in claim 12 comprising:

the panel of the guard comprising a port and a screen;

the port being positioned on the panel adjacent the first truss;

the screen being attached to the port to fully cover the port; and the screen being positioned opposite the first leg and the second leg of the frame.

15. The mobile hand-maneuverable ballistic shield and firing platform as claimed in claim 12 comprising:

the frame comprising a first guide, a second guide, a tray, a block, and a plurality of fasteners;

the first guide and second guide being colinearly and terminally attached to the front of the first stanchion and the second stanchion, respectively;

the tray being terminally attached to the first stanchion and the second stanchion, adjacent to the second truss;

the block being colinearly inserted to the first truss; and the block being mounted to the first truss using the plurality of second fasteners.

16. The mobile hand-maneuverable ballistic shield and firing platform as claimed in claim 12 comprising:

the frame comprising a first strut, a second strut, a third strut, and a fourth strut;

the first strut and the second strut being terminally attached to the first leg and the second leg, respectively;

the first strut and the second strut being terminally attached to the first stanchion and the second stanchion, respectively, and adjacent the brace;

the third strut being terminally connected to the first stanchion and the joint between the first leg and the first strut;

the fourth strut being terminally connected to the second stanchion and the joint between the second leg and the second strut; and the third strut and fourth strut being positioned perpendicularly to the first stanchion and the second stanchion, respectively.

17. The mobile hand-maneuverable ballistic shield and firing platform as claimed in claim 12, wherein the guard and the frame are supported at an acute angle with respect to the first leg and the second leg of the frame.

18. The mobile hand-maneuverable ballistic shield and firing platform as claimed in claim 12 comprising:

the brace comprising a first pivot, a second pivot, a first latch, a second latch, a first stopple, and a second stopple;

the first pivot and the second pivot being mounted to the first girder;

the first pivot and the second pivot being positioned adjacent the first stanchion and the second stanchion of the frame, respectively, and opposite the guard;

the first stopple and the second stopple being concentrically and rotatably attached to the first pivot and the second pivot, respectively;

the first latch and the second latch being mounted to the second girder;

the first latch and the second latch being positioned adjacent the first stopple and the second stopple, respectively;

the first stopple and the second stopple being latched by the first latch and the second latch, respectively; and the first stopple and the second stopple being positioned opposite the first aperture and the second aperture of the guard, respectively, when latched.

19. The mobile hand-maneuverable ballistic shield and firing platform as claimed in claim 12 comprising:

each of the plurality of casters comprising a wheel, an axle, a bearing, and a bracket;

the wheel being concentrically and rotatably mounted to the bearing;

the bearing being concentrically and rotatably mounted to the axle;

the axle being mounted to the bracket; and the bracket being terminally mounted to the frame.

20. A mobile hand-maneuverable ballistic shield and firing platform comprising:

a guard;

a frame;

a brace;

a plurality of casters;

a magazine;

the guard being bullet-proof;

the guard comprising a panel, a first aperture, and a second aperture;

the first aperture and the second aperture being distally and laterally positioned across the panel;

the guard being detachably attached to the front of the frame;

the frame comprising a first stanchion, a second stanchion, a first truss, a second truss, a first leg, and a second leg;

the first stanchion and the second stanchion being laterally positioned across the frame opposite each other;

the first truss being terminally positioned on both the first stanchion and the second stanchion;

the second truss being positioned between the first stanchion and the second stanchion opposite the first truss;

the first leg being attached to the first stanchion opposite the guard and adjacent the second truss;

the second leg being attached to the second stanchion opposite the first leg along the second truss;

the brace comprising a first girder, a second girder, a first tie, a second tie, a haft, and a loop;

the first girder and the second girder being attached to between the first stanchion and the second stanchion of the frame, adjacent the longitudinal midpoint;

the first girder of the brace being positioned on the frame adjacent the first truss and opposite the second girder;

the first tie and the second tie being terminally attached to the first girder and the second girder;

the first tie being positioned adjacent first stanchion of the frame, opposite the second tie along the first girder;

the loop being attached to the first girder and the second girder opposite the guard;

the haft being attached to the second tie opposite the guard; and the plurality of casters being terminally mounted to the first leg and the second leg of the frame;

the magazine being detachably mounted to the second girder of the brace, opposite the guard; and wherein the magazine is used to provide storage for ammunitions.

* * * * *